US006003882A

United States Patent [19]

Colonese, Jr. et al.

[11] Patent Number: 6,003,882

[45] **Date of Patent: *Dec. 21, 1999**

[54] CUSTOMIZABLE SKATE WITH REMOVABLE WHEEL HANGERS

[75] Inventors: Joseph Colonese, Jr.; Michael S. Delia, both of Lincoln Park, N.J.

[73] Assignee: V-Formation, Inc., Lincoln Park, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/746,681

[22] Filed: Nov. 14, 1996

[51] Int. Cl.[6] ..... A63C 17/04

[52] U.S. Cl. ..... 280/11.22; 280/11.19; 280/11.27

[58] Field of Search ..... 280/11.19, 11.22, 280/11.27, 11.28, 11.23, 11.25, 11.3, 841; 301/1, 5.3, 5.7, 105.1, 111, 114

[56] References Cited

U.S. PATENT DOCUMENTS

| | | | |
|---|---|---|---|
| 189,783 | 4/1877 | Post . | |
| 280,236 | 6/1883 | Phillips . | |
| 327,517 | 10/1885 | Britt, Jr. . | |
| 954,993 | 4/1910 | Peters . | |
| 1,116,840 | 11/1914 | Porter . | |
| 1,552,541 | 2/1925 | Clark . | |
| 1,801,205 | 5/1931 | Mirick . | |
| 1,975,661 | 10/1934 | Powell . | |
| 2,212,589 | 8/1940 | Decker . | |
| 2,412,290 | 12/1946 | Rieske . | |
| 2,440,650 | 4/1948 | Batesole | 301/5.7 |
| 2,670,242 | 2/1954 | Beckman . | |
| 3,287,023 | 11/1966 | Ware . | |
| 3,414,280 | 12/1968 | Ohashi | 301/5.3 |
| 3,756,614 | 9/1973 | Grubin . | |
| 3,777,796 | 12/1973 | Takano | 411/544 |
| 3,880,441 | 4/1975 | Silver . | |
| 3,885,804 | 5/1975 | Cudmore . | |
| 3,900,203 | 8/1975 | Kukulowicz . | |
| 3,963,252 | 6/1976 | Carlson . | |

(List continued on next page.)

FOREIGN PATENT DOCUMENTS

| | | |
|---|---|---|
| 1122229 | 10/1954 | France . |
| 215734 | 11/1909 | Germany . |
| 579406 | 10/1974 | Switzerland . |
| WO 96/36531 | 11/1996 | WIPO . |

*Primary Examiner*—J. J. Swann
*Assistant Examiner*—James S. McClellan
*Attorney, Agent, or Firm*—Pennie & Edmonds LLP

[57] ABSTRACT

A skate comprising a foot enclosure with a ball region and a heel region includes a first hanger set coupled to the foot enclosure adjacent the ball region, and a second hanger set coupled to the foot enclosure adjacent the heel region. The skate further includes a plurality of wheels corresponding in number to the hangers of the first and second hanger sets wherein the wheels are rotatably and angularly coupled to the corresponding hangers. The skate may be customizable in that the hangers may be selectively and removably coupled to the foot enclosure. A method for customizing a wheel arrangement on a skate is also disclosed.

1 Claim, 16 Drawing Sheets

U.S. PATENT DOCUMENTS

| | | | |
|---|---|---|---|
| 4,054,335 | 10/1977 | Timmer . | |
| 4,114,952 | 9/1978 | Kimmell . | |
| 4,272,090 | 6/1981 | Wheat . | |
| 4,323,259 | 4/1982 | Boudreau . | |
| 4,332,394 | 6/1982 | Klawitter . | |
| 4,401,311 | 8/1983 | Almeraz . | |
| 4,492,385 | 1/1985 | Olson . | |
| 4,618,158 | 10/1986 | Liberkowski . | |
| 4,711,458 | 12/1987 | Shim | 280/11.22 |
| 4,909,523 | 3/1990 | Olson . | |
| 4,928,982 | 5/1990 | Logan . | |
| 4,995,626 | 2/1991 | Montague . | |
| 5,048,848 | 9/1991 | Olson . | |
| 5,092,614 | 3/1992 | Malewicz . | |
| 5,183,276 | 2/1993 | Pratt . | |
| 5,251,920 | 10/1993 | McHale . | |
| 5,294,187 | 3/1994 | Racicot | 301/1 |
| 5,303,940 | 4/1994 | Brandner . | |
| 5,342,071 | 8/1994 | Soo | 280/11.22 |
| 5,346,231 | 9/1994 | Ho | 280/11.22 |
| 5,348,321 | 9/1994 | Sbrilli . | |
| 5,362,075 | 11/1994 | Szendel . | |
| 5,382,031 | 1/1995 | Marconato et al. . | |
| 5,397,138 | 3/1995 | Mangelsdorf . | |
| 5,411,278 | 5/1995 | Wittmann | 280/11.22 |
| 5,437,466 | 8/1995 | Meibock et al. . | |
| 5,452,907 | 9/1995 | Meibock et al. . | |
| 5,456,477 | 10/1995 | Bourdeau . | |
| 5,513,861 | 5/1996 | Monroy et al. | 301/5.3 |
| 5,566,957 | 10/1996 | Ho | 280/11.22 |
| 5,690,344 | 11/1997 | Chen | 280/11.22 |

FIG. 10A
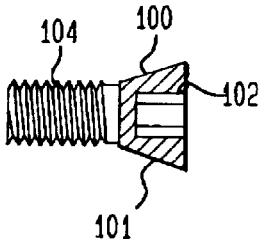
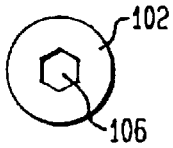
FIG. 10B
FIG. 10C
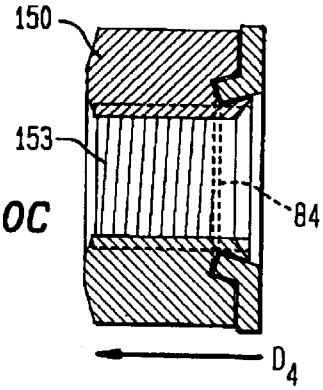
FIG. 10D
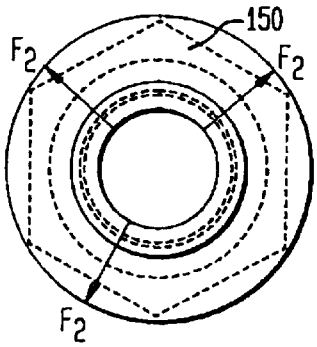
FIG. 10E
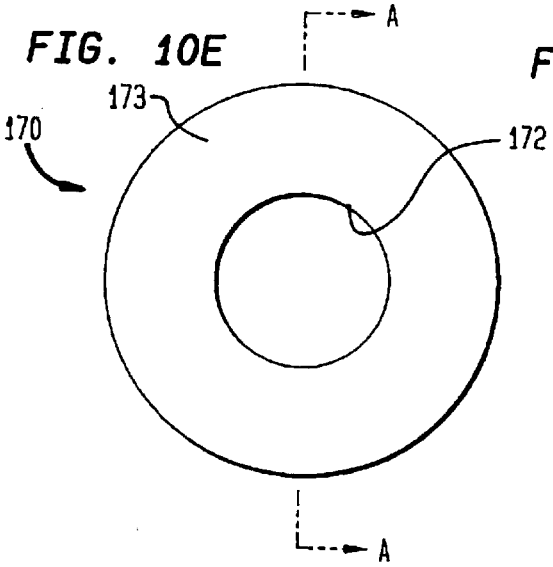
FIG. 10F
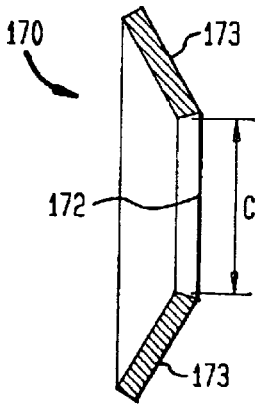
FIG. 10G
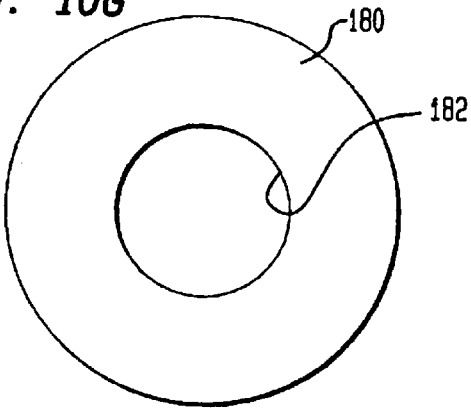
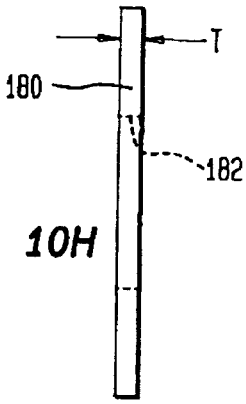
FIG. 10H

CUSTOMIZABLE SKATE WITH REMOVABLE WHEEL HANGERS

BACKGROUND OF THE INVENTION

1. Field of the Invention

The invention relates to a skate and preferably to an in-line skate having angularly mounted wheels. Preferably, the wheel arrangement and wheel mounting design allow the skate to be customizable and optimally angled to the skating surface. Axle force distribution, wheel hanger design and mounting plate configuration improve performance of the skate.

2. Description of the Related Art

Skates having a plurality of wheels aligned in-line on a common vertical plane are known. Typically, an in-line roller skate includes a one piece frame with parallel axle apertures formed through the frame. Axles for the wheels are disposed in the apertures along the one piece frame. In this way, all wheels are disposed in a similar vertical angular configuration. Some embodiments of in-line skates position the wheels of a skate at varying vertical heights. Some also include quick release features of the wheels.

In-line skates have the advantage over conventional roller skates of having the feel and behavior associated with ice skates. Several attempts have been made to improve performance of the in-line skate.

A skate wherein the wheels are angularly mounted to the skate is disclosed in U.S. Pat. No. 5,303,940 ('940 patent) that describes an in-line skate having wheels disposed in an angular relationship to the vertical plane. The wheels are affixed in a consistently even, closely spaced, relationship along one longitudinal axis. In one embodiment, an intermediate wheel is inclined in an opposite direction with respect to at least two angularly disposed wheels for allowing overlap between the wheels and making it possible to mount more wheels on the skate than is possible with conventional vertical in-line wheel mounting. This is referred to as a V-line skate. Alternatively, the wheels may be mounted so that they are angled in the same direction.

In the '940 patent, the mounting plate has a length shorter than the sole of the boot for attaching the closely spaced wheels to the bottom of the skate. Mounting brackets have a cantilevered support for a single wheel with the upper part of the bracket being permanently attached to the mounting plate. An axle is attached to the mounting bracket and a wheel attached to the axle. Reversal of wheel angle is effected by turning the mounting plate end for end and reinstalling the mounting plate on the boot.

The skate described in the '940 patent has at least the shortcomings that permanent hanger brackets prevent easy customization of the skate. Also, the mounting brackets and axle can contact the skating surface during extreme angulation of the skate towards the skating surface resulting in an unrecoverable slide. In addition, the alignment of closely spaced wheels along a singular common longitudinal axis on a shortened plate results in a shortened wheel base and instability of the skate.

It is desirable to provide a skate which can be easily and readily customized by the skater and can provide improved performance characteristics of the skate including during angulation of the skate towards the skating surface.

SUMMARY OF THE INVENTION

A skate comprising a boot having a sole and side surfaces, the sole having a ball region and a heel region; a first hanger set comprising two hangers coupled to the sole about the ball region, and a second hanger set comprising two hangers coupled to the sole about the heel region; and wheels rotatably mounted on the corresponding hangers in an alternating angular configuration relative to and along the plane of the sole.

Preferably, each adjacent pair of wheels in the first and the second hanger sets is nonplanar. A plate member is disposed and coupled between the sole and the hangers whereby the wheels are positioned on axles positioned through the hangers below the plate member such that at least a portion of each of the wheels can contact a skating surface. The plate member and the hangers are dimensioned and configured such that when the skate is angulated to the skating surface, at least a portion of the side surfaces of the boot contacts the skating surface before the hangers, the plate member and the axle contact the skating surface. In one preferred embodiment, the hangers are mounted along at least a pair of centers over which the skater's weight is positioned. The tread surface of the wheels are aligned along a plane positioned between the pair of centers. The first pair of hangers is spaced from the second pair of hangers at a distance unequal to the distance between the hangers of the first pair and the distance between the hangers of the second pair. The plate member can be integral to the boot.

The skate further comprises a first pair of plate mounting holes disposed on a first lateral axis at the ball of the foot position in the plate member; a second pair of plate mounting holes disposed on a second lateral axis at the heel of the foot position in the plate member; and a plurality of plate fasteners received in the first and second pair of the plate mounting holes for mounting the boot to the hanger mounting plate. The plate member has a length $L_1$ which is substantially the same as the length of the sole of the boot. Also the plate member of the skate has a rounded front and rear end. The front and rear ends have a radius $R_1$ and $R_2$, respectively, which are substantially the same size as the front and rear ends of the sole of the boot for optimal plate length. The wheels have a diameter preferably in the range of about 70 mm to about 76 mm.

The present invention is also directed to a skate comprising a foot enclosure having a ball region and a heel region; a first hanger set of at least two hangers coupled to the foot enclosure adjacent one of the ball and the heel regions, and a second hanger set of at least one hanger coupled to the foot enclosure adjacent the other of the ball and the heel regions; and plurality of wheels corresponding in number to hangers of the first and the second hanger sets, the wheels being rotatably and angularly coupled to the corresponding hangers. At least two of the wheels corresponding to the first hanger set are in a nonplanar configuration.

In addition, the present invention relates to a customizable skate comprising a foot enclosure having a ball region and a heel region; a first hanger set of at least one hanger selectively and removably coupled to the foot enclosure adjacent one of the ball and the heel regions, and a second hanger set of at least one hanger selectively and removably coupled to the foot enclosure adjacent the other of the ball and the heel regions; and a plurality of wheels corresponding in number to the hangers of the first and the second hanger sets, the wheels being rotatably and angularly coupled to the corresponding hangers.

The present invention also relates to a customizable skate comprising a boot having a sole and side surfaces, the sole having a ball region and a heel region; first hanger set comprising two hangers selectively and removably coupled to the sole about the ball region, and a second hanger set comprising two hangers selectively and removably coupled to the sole about the heel region; and wheels rotatably coupled to the corresponding hangers in an alternating angular configuration relative to and along the plane of the sole.

Furthermore, the present invention is directed to a chassis for a customizable skate including a boot having a sole, comprising a plate member being dimensioned and configured for attachment to the sole of the boot and having a ball region and heel region corresponding to like regions on the sole, the plate member having a first plurality of apertures positioned near the ball region of the plate member and a second plurality of apertures positioned near the heel region of the plate member; and at least one hanger selectively and removably coupled in a predetermined configuration to the first plurality of apertures and at least one hanger selectively and removably coupled in a predetermined configuration to the second plurality of apertures.

A hanger system for use with an axle in angularly mounting a wheel on a customizable skate including a boot with a sole comprises a hanger body having a mounting surface which is configured and dimensioned for selective and removable attachment to the sole; and a passageway in the hanger body through which the axle can pass. The hanger system further includes axle means having a first and a second end with the wheels being supported on the first end of the axle mechanism, and the second end of the axle mechanism being received in the passageway of the hanger. The second end of the axle mechanism does not extend past the hanger upon insertion therein. Preferably the axle is positioned at a distance $D_2$ from a plate member disposed and coupled between the sole and the hanger, which distance $D_2$ extends beyond the center of the hanger thereby providing additional clearance for mounting increased diameter wheels on the hanger. The hanger further comprises a three dimensional shape having an inner side surface and an outer side surface, the inner side surface protruding angularly from the outer side surface; an open core positioned within the side surfaces; and a bottom surface integral with the inner side surface and the outer side surface. Preferably, the hanger is formed of a glass reinforced nylon.

In a preferred embodiment, the hanger system further comprises a plurality of hanger mounting means formed in the bottom surface of the hanger; and a plurality of hanger mounting screws positioned in a plate member disposed and coupled between the sole of the hanger received in the hanger mounting means, whereby a skater can expeditiously customize the number and location of hangers mounted to the skate by removing and remounting the hangers. The hanger mounting means comprises preferably first and second hanger mounting holes aligned along a first longitudinal axis of the plate member and a third hanger mounting hole aligned along a second longitudinal axis, the first longitudinal axis is positioned adjacent the outer edge of the plate member and the second longitudinal axis is parallel to the first longitudinal axis and is positioned toward the inner edge of the plate member. The hanger mounting holes have a tapered shape. Alternatively, the hanger mounting means comprises a first mounting slot aligned along a first longitudinal axis and a second mounting slot aligned along a second longitudinal axis wherein the first longitudinal axis is positioned adjacent the outer edge of the plate member and is parallel to the second longitudinal axis.

The axle means comprise an axle for receiving the wheels at a first end thereof; a threaded portion positioned at a second end of the axle; and a flange positioned between the first and the second ends of the axle. An axle aperture has a circular shape and the flange of the axle has a circular shape for mating with the axle aperture.

The hanger system further comprises an axle tip screw received in a screw aperture in the first end of the axle means for mounting the wheel to the axle. A side surface of the wheel extends a distance $d_1$ from the end of the axle tip screw when the axle tip screw is inserted in the screw aperture. Alternatively, side surface of the wheel is aligned with the end of the axle tip screw when the axle tip screw is inserted in the screw aperture. The hanger system further comprises fastener means threadedly coupled to the threaded portion of the axle adjacent the hanger. In one preferred embodiment, a washer means is positioned between the fastener means and the hanger. The washer means comprises a circular spring positioned around an aperture.

The present invention is also directed to a method for customizing a wheel arrangement on a skate comprising a foot enclosure having a ball region and a heel region; a first hanger set of at least one hanger configured and dimensioned for selectively and removably coupling to the foot enclosure adjacent one of the ball and the heel regions, and a second hanger set of at least one hanger configured and dimensioned for selectively and removably coupling to the foot enclosure adjacent the other of the ball and the heel regions; and plurality of wheels corresponding in number to the hangers of the first and the second hanger sets, the wheels being rotatably and angularly coupled to the corresponding hangers; and mounting at least one hanger of the first set in a predetermined configuration on the foot enclosure adjacent the ball region of the foot enclosure and mounting at least one hanger of the second set in a predetermined configuration on the foot enclosure adjacent the heel region of the foot enclosure. The method further comprising removing at least one hanger from the foot enclosure from either the first set or the second set and remounting the hanger in a new position on the foot enclosure.

The skate of the present invention has many advantages over prior art skates including a tighter turn radius, more stability, improved performance, quicker sprinting ability and a superior stopping ability.

BRIEF DESCRIPTION OF THE DRAWINGS

These and other objects, features and advantages of the invention will be readily apparent from the following detailed description of the preferred embodiments of the invention in which:

FIG. 10A is a side view of an axle tip screw used for fastening the wheels to the axle;

FIG. 10B is a front view of the axle tip screw shown in FIG. 10A;

FIG. 10C is a vertical cross sectional view of a fastener for mounting the axle to the hanger;

FIG. 10D is a front end view of the fastener shown in FIG. 10C;

FIG. 10E is a front view of a washer used with a fastener for mounting the axle to the hanger;

FIG. 10F is a side view taken along lines A—A of FIG. 10E;

FIG. 10G is a front view of an alternative washer used with a fastener for mounting the axle to the hanger;

FIG. 10H is a side view of the washer shown in FIG. 10G;

DETAILED DESCRIPTION OF THE PREFERRED EMBODIMENTS

In the description which follows, any reference to either direction or orientation is intended primarily and solely for purposes of illustration and is not intended in any way as a limitation to the scope of the present invention. Also, the particular embodiments described herein, although being preferred, are not to be considered as limiting the present invention. Furthermore, like parts or elements in the various drawings are identified by like numerals for ease of reference.

Figure 1:
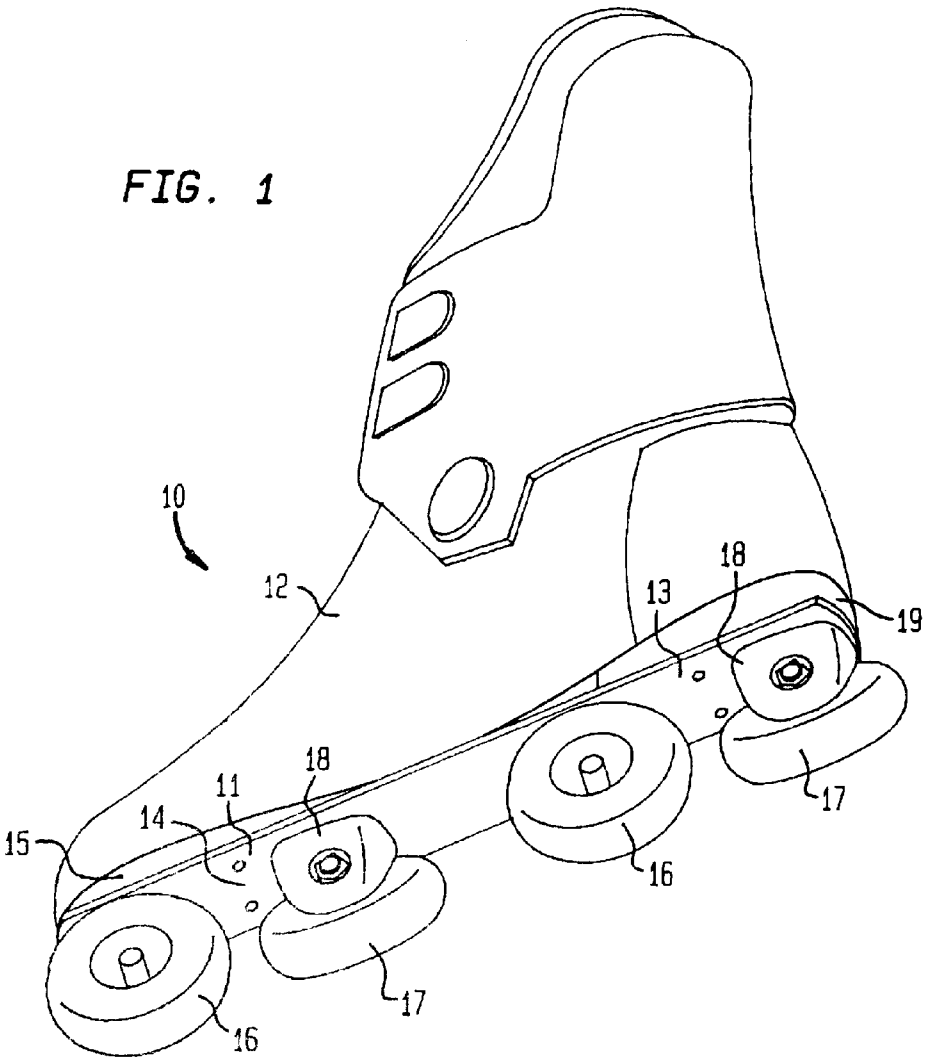
FIG. 1 is a side perspective view of a preferred embodiment of a skate according to the present invention.

FIG. 1 illustrates a perspective view of skate 10 in accordance with the teachings of the present invention. Mounting plate member 14 is mounted to sole 15 of boot or foot enclosure 12. A plurality of wheels 16 and 17 are angularly mounted or coupled to plate member 14 with hangers 18. Angularly mounted means at an angle to the vertical, which is generally orthogonal to the plane of the mounting plate. Preferably, two to five wheels 16, 17 are mounted to mounting plate 14. Most preferably, four wheels are mounted to mounting plate 14 with a pair of wheels 16, 17 positioned adjacent the ball region 11 of skate 10 and spaced unevenly from a pair of wheels 16, 17 positioned adjacent the heel region 13 of skate 10. Positioning of wheels 16, 17 in two pairs unevenly spaced from one another advantageously positions wheels 16, 17 under the ball and heel of the foot which are the parts of the foot from which optimal power and control is transferred from the foot to skate 12.

In one embodiment, heel spacer 19 can be disposed, if desired, between sole 15 and mounting plate 14, the details of which will be further described below. Alternatively, the heel spacer 19 can be integrally formed as part of the foot enclosure or boot 12. Mounting plate 14 and hangers 18 comprise the chassis of skate 10. Wheels 16, 17 are mounted on the hangers 18 of the chassis of skate 10. As shown in the embodiment of FIG. 1, the spacing between the pairs of wheels is not equal to the spacing between the wheels 16, 17. In addition, the spacings between the wheels on one pair may not be equal to the spacing between the wheels on the other pair.

Figure 2A:
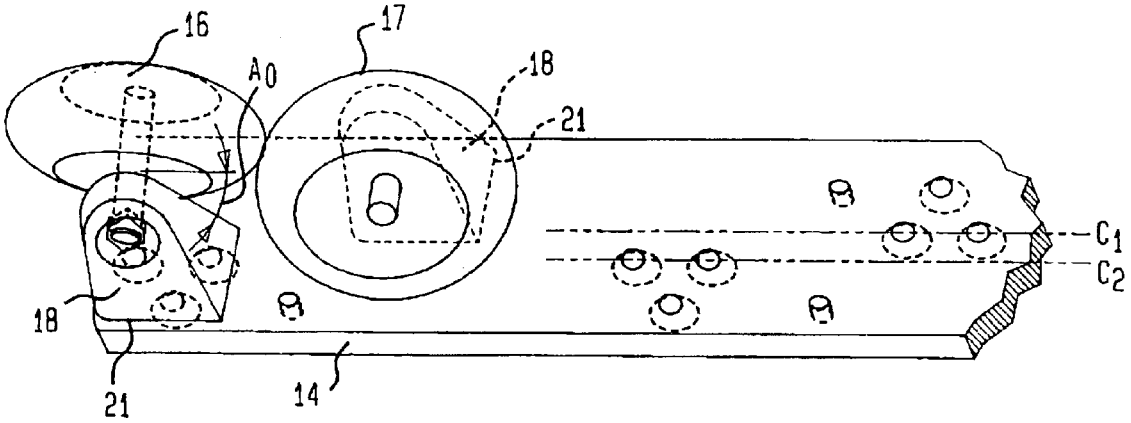
FIG. 2A is a perspective view of an arrangement of hangers used for mounting wheels on the skate of FIG. 1.
Figure 2B:
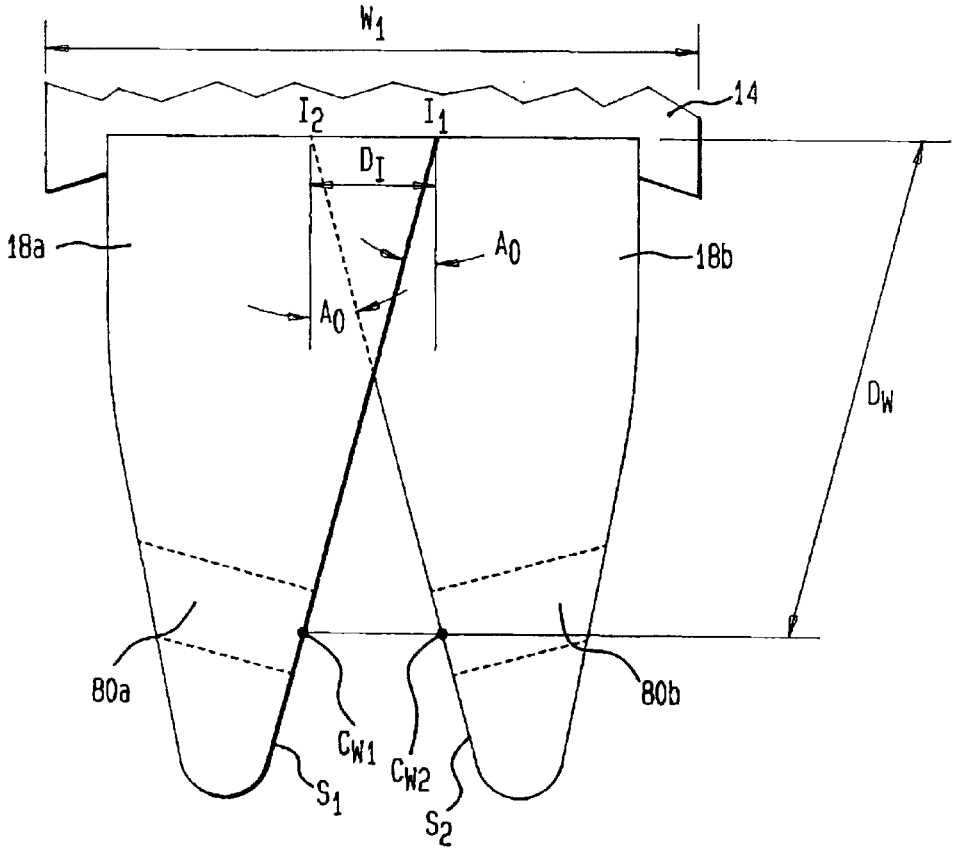
FIG. 2B is a schematic front end view of the mounting of the hangers shown in FIG. 2A.

Wheels 16 and 17 are in-line skate wheels known in the art and may comprise round, v-shaped, flat or other known wheel profiles. Wheels 16 and 17 are preferably mounted at alternating angles to mounting plate 14 as shown in FIG. 2A. If desired, the wheels can be mounted with the same angular orientation (not shown). Wheels 16, 17 can be mounted at an angle $A_0$, which is parallel to wheel mounting surface $S_1$ and $S_2$, respectively, of hanger 18 as shown in FIG. 2B. Angle $A_0$ is between about 4 to 40 degrees and preferably, at about an angle of 16° to the vertical. The angulation of wheels 16 and 17 lowers the skate boot closer to the skating surface than wheels of conventional vertically mounted in-line skates. This increases stability, maneuverability and control of the skates. In addition, if the wheel closest to the front of the right boot is angulated to the right and vice versa to the left for the left boot as shown in FIG. 1, it provides the skater with improved performance when striking off.

Hangers 18*a* and 18*b* are mounted, as shown in FIG. 2B, to mounting plate 14 by aligning wheel mounting surfaces $S_1$ and $S_2$ at intersections $I_1$ and $I_2$, respectively, of mounting plate 14. As is illustrated in the figure, hanger 18*a* and 18*b* overlap a distance $D_I$ near the mounting plate, thereby being aligned on two parallel longitudinal planes.

Axles 80*a* and 80*b* are positioned in hangers 18*a* and 18*b*, respectively, at a distance, $D_W$, from the mounting plate to the centers $C_{W1}$ and $C_{W2}$ of the axle apertures located on the wheel mounting surfaces $S_1$ and $S_2$. A proper combination of hanger overlap distance $D_I$, axle position relative to the hanger, and wheel size and angle of orientation allows the wheels to align on one center plane at the skating surface. For example, the wheels will align when using a wheel of about 24 mm in width, about 72 mm in diameter and angled 16° to the vertical, a hanger overlap distance $D_I$ of about 6.5 mm and an axle location distance $D_W$ of 38 mm. For a wheel of about 76 mm in diameter having the same width and angular orientation and the same distance $D_W$, the wheels will align when distance $D_I$ equals about 9 mm.

Figure 2C:
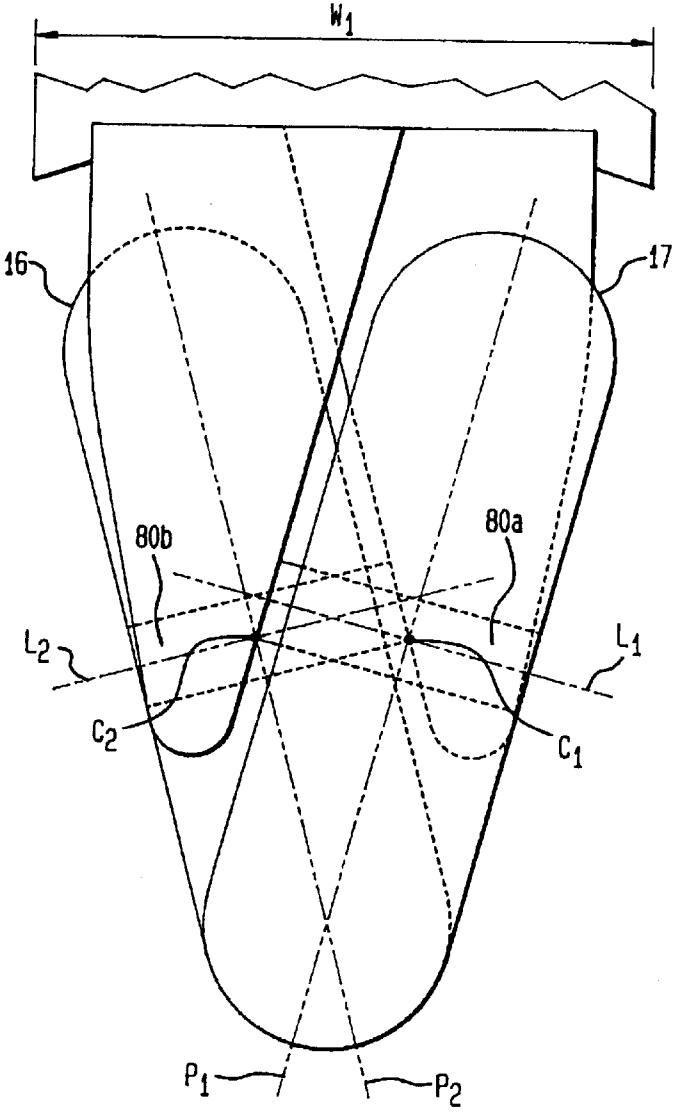
FIG. 2C is a schematic front end view of the mounting of wheels on the hangers shown in FIG. 2B.

As shown in FIG. 2C, each pair of wheels 16, 17 includes two centers $C_1$ and $C_2$ over which the skater's weight is distributed. $C_1$ is located at the intersection of the longitudinal axis $L_1$ of axle 80*a* and the central plane $P_1$ of wheel 17. $C_2$ is located at the intersection of the longitudinal axis $L_2$ of axle 80*b* and the central plane $P_2$ of wheel 16. Distributing the weight over these two centers allows the skater to more easily maintain the skate in an angulated orientation. Additionally, it allows for tighter turns, quicker transitioning from edge to edge and has superior hold ability during turns than prior art skates.

The width $W_1$ of mounting plate 14 can be the same or narrower than the width $W_2$ of the sole 15 of boot 12 to prevent mounting plate 14 from contacting the skating surface when skate 12 is angulated. Preferably, the ratio of the width of the sole 15 ($W_2$) to the width of the mounting plate ($W_1$) ($W_2/W_1$) is between about 1:1 to about 1½:1.

It has been found that wheels having a diameter of about 60 mm to about 85 mm can be mounted on mounting plate 14 if the shape and size of hanger 18 is adjusted to accommodate the size of the diameter of the wheel. The hanger is also shaped and sized in accordance with the width of the mounting plate 14. The overall width of hanger 18 is designed so that hanger 18, when mounted, does not extend laterally out from the outer plane of the wheels in order to avoid contact of any surface of hanger 18 with the skating surface when the skate is angulated. Generally, the sides of boot 12 will contact the skating surface before either the mounting plate 14 or hanger 18 can contact the skating surface. The contact portions of boot 12 can be reinforced with pads or other suitable structures. Preferably, wheels 16, 17 have a diameter of about 60 mm to about 85 mm and, most preferably, wheels 16, 17 have a diameter of about 70 mm to about 76 mm.

As discussed above, it has been found that by adjusting the vertical positioning of axle 80 with respect to hangers 18 and adjusting the horizontal positioning of hangers 18 with respect to mounting plate 14, the skate can accommodate different size wheels with the same overall size hanger 18.

Figure 3A:
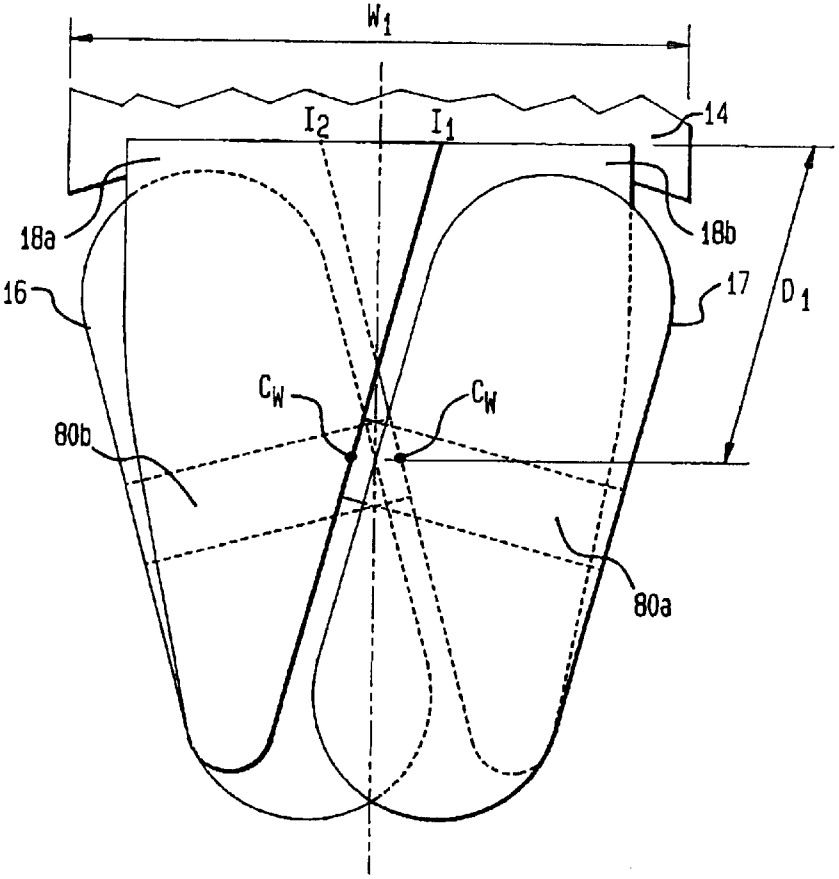
FIG. 3A is a schematic front end view of the mounting of the wheels at the center of the hanger.
Figure 3B:
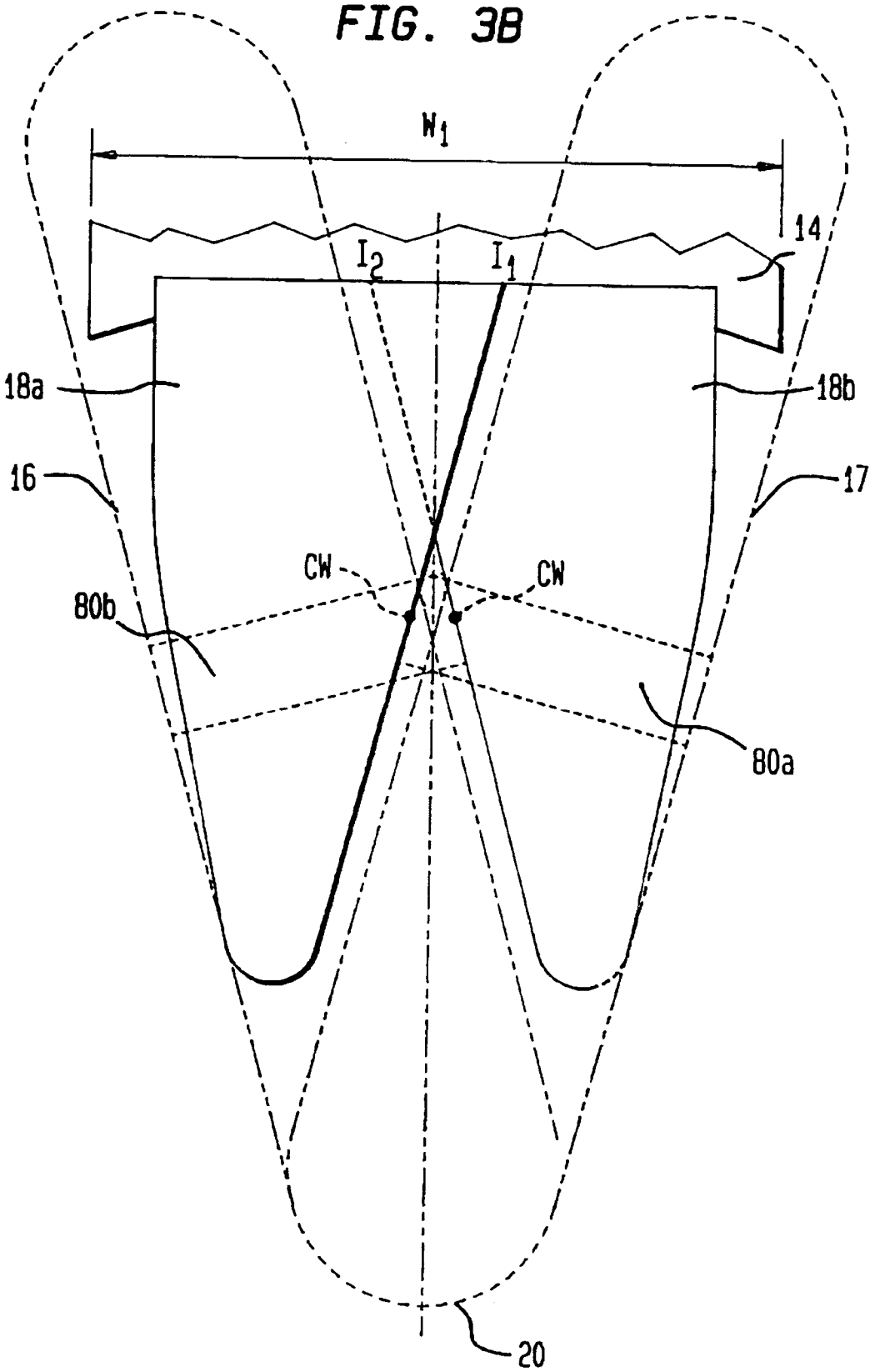
FIG. 3B is a schematic front end view of the mounting of larger diameter wheels at the center of the hanger.
Figure 3C:
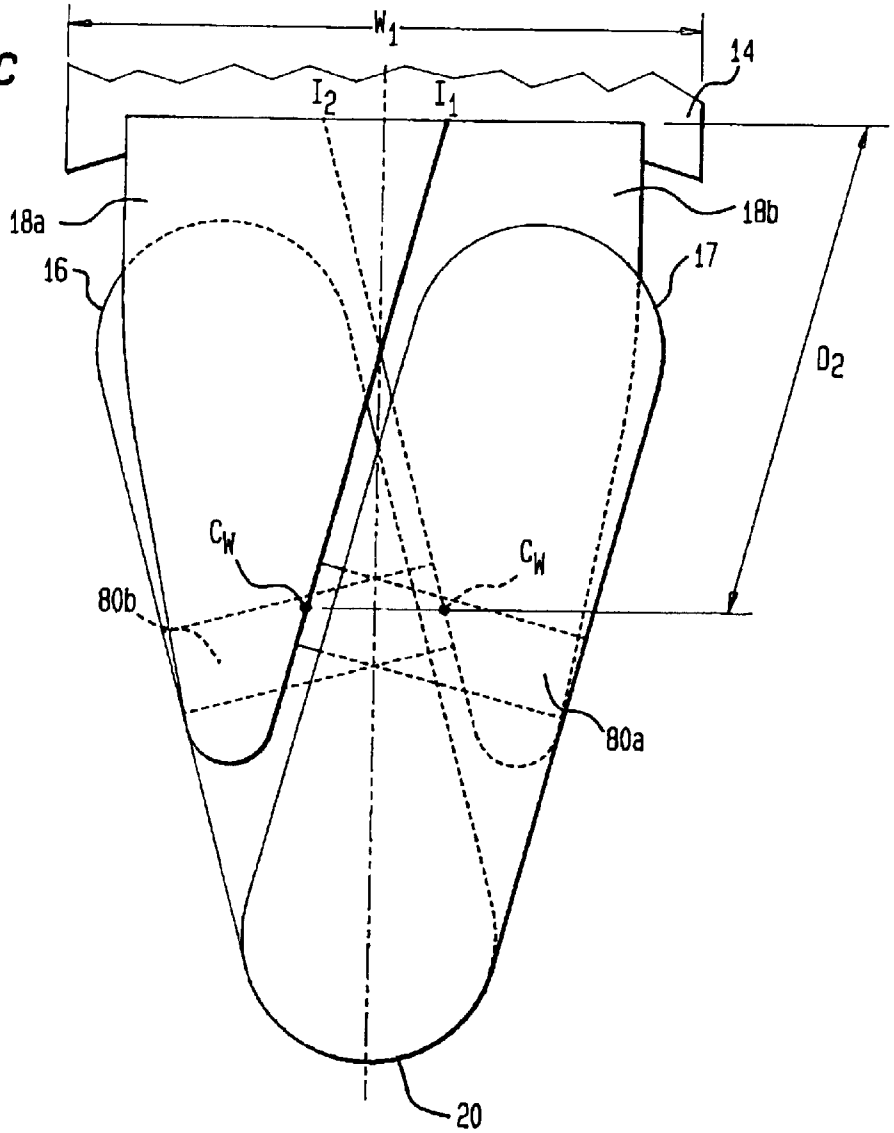
FIG. 3C is a schematic front end view of the mounting of the wheels below the center of the hanger.

FIG. 3A illustrates the effect of positioning axles 80*a* and 80*b* at a lesser distance than desired from mounting plate 14, a distance $D_1$ from the center $C_W$ of hangers 18 to the mounting plate. As is apparent from the figure, the wheels are not in alignment (i.e., the wheels are not centered around the same center plane). In order to bring the wheels into alignment as in FIG. 2B when the axles are positioned in this way, the wheel diameter must be increased. However, the wheel diameter cannot be increased because that would result in the wheels going through the mounting plate 14 as shown in FIG. 3B. It has been found that increasing the distance of axles 80*a* and 80*b* from mounting plate 14 to a distance $D_2$ as shown in FIG. 3C, provides additional clearance between the wheels and mounting plate 14, thereby allowing hangers 18 to accommodate larger wheel diameters, such as a wheel having about a 76 mm diameter. Hangers 18*a* and 18*b* preferably may be positioned along the width of the mounting plate 14 apart from each other so that when wheels 16, 17 are attached to respective hangers 18*a* and 18*b*, they are aligned along a center plane as shown in FIG. 3C.

Figure 4:
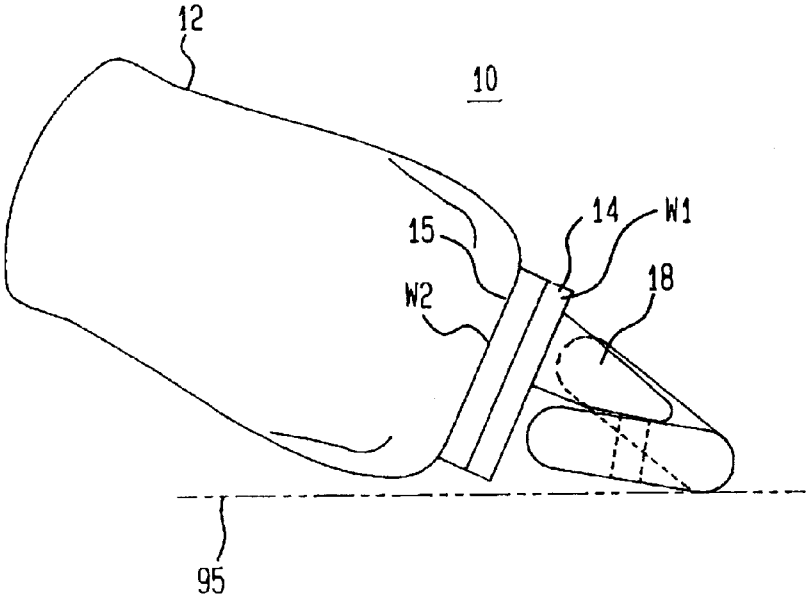
FIG. 4 is a rear view of the skate of FIG. 1 during angulation of the skate leftwardly towards the skating surface.

As described above, hanger 18 is formed of a size and shape to prevent contact of hanger 18 with the skating surface when boot 12 is angulated towards the skating surface. FIG. 4 illustrates angulation of skate 10 towards skating surface 95. Positioning of hangers 18 on mounting plate 14 having a width which is the same size or narrower than the sole of the boot 12 places hangers 18 under boot 12. The size and shape of hangers 18 and aligning of the hangers 18 along more than one longitudinal plane along mounting plate 14 to create an overlap between the hangers allows the hangers to be positioned closer together on the mounting plate. This prevents attached hangers 18 from contacting skating surface 95 when boot 12 is angulated towards the skating surface. The contact of boot 12 with skating surface 95 without contact of hanger 18 on the skating surface has the advantage that the skater can maintain a controllable slide or skid should that occur.

Figure 5:
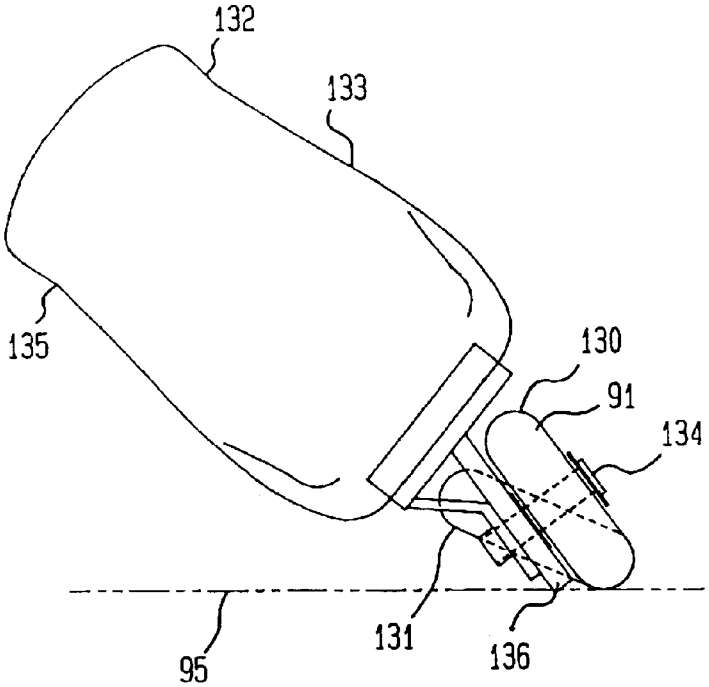
FIG. 5 (PRIOR ART)
FIG. 5 is a rear view of a prior art skate (U.S. Pat. No. 5,303,940) during angulation of the skate leftwardly towards the skating surface.

FIG. 5 shows the angulation of a prior art skate having angularly mounted wheels 130, 131 shown in U.S. Pat. No. 5,303,940. Angulation of side 135 of boot 132 to skating surface 95 allows bracket 136 to contact skating surface 95 before boot 132 contacts the surface 95. The contact of bracket 136 with skating surface 95 results in the skate skidding out from under the skater during angulation of the skate. Such undesired contact impairs performance of the skate and possibly might lead to injury.

Figure 6A:
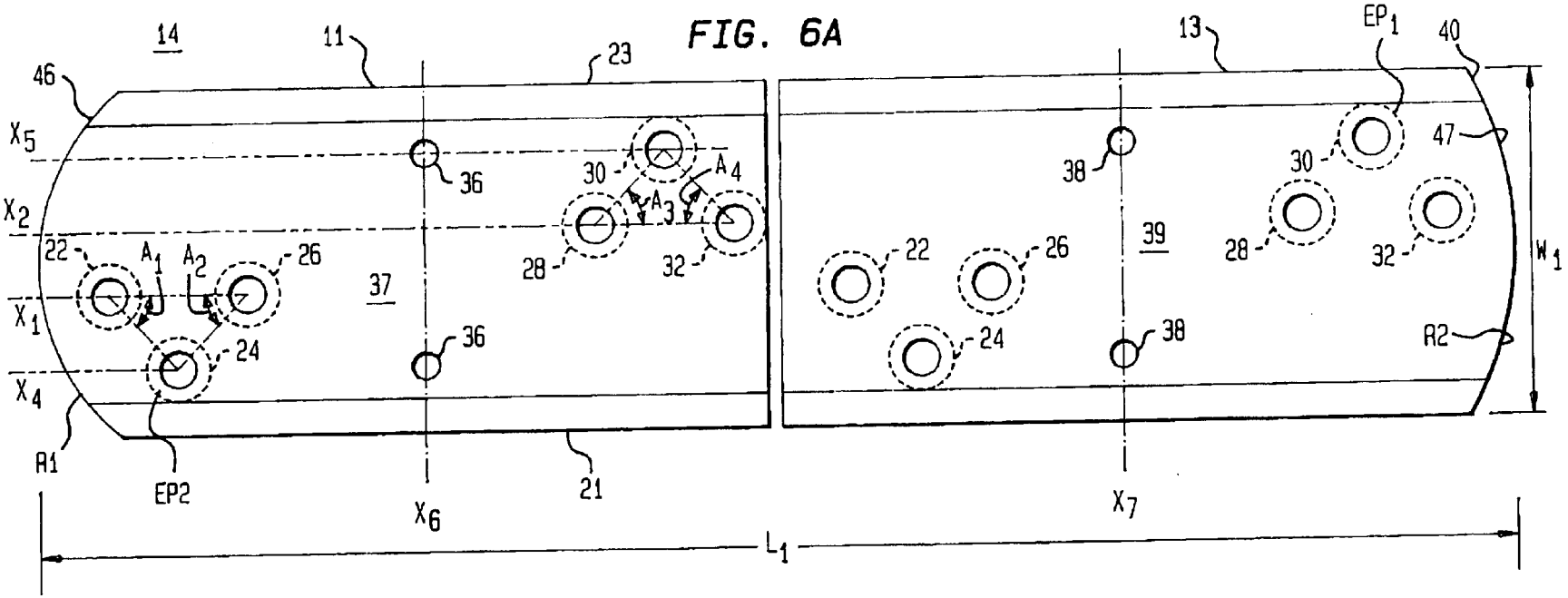
FIG. 6A is a bottom plan view of a mounting plate of the skate according to FIG. 1.

FIG. 6A is a bottom view of mounting plate 14 which provides the base to which hangers 18 (not shown) can be mounted. Preferably, mounting plate 14 is designed and structured to be strong and light. Mounting plate 14 is shaped to resist torsional flexing as well as longitudinal and transverse flexing. Mounting plate 14 is preferably formed of a rigid material to avoid lateral bending of the plate and to allow mounting plate 14 to withstand repeated impact and forces during skating. In one preferred exemplary embodiment, mounting plate 14 can be formed of 7075-T7 aluminum for strength and low manufacturing costs. However, other materials are also contemplated within the scope of the present invention.

Mounting plate 14, as shown in FIG. 6A, has a length $L_1$ which preferably has substantially the same length as sole 15 of boot 12. The length of mounting plate 14 allows for the maximum distance of placement of hangers 18 along mounting plate 14, thereby providing the skater with improved ability to place wheels or sets of wheels in the ball region 11 and heel region 13. The ends 46 and 47 of mounting plate 14 can be curved with respective radii $R_1$ and $R_2$ for extending the usable length of mounting plate 14. Also, such radii allow mounting plate 14 to conform generally to the curved configuration of the corresponding fore and aft of sole 15. The increased length of mounting plate 14 preferably utilizes the entire boot length and allows hangers 18 to be mounted at end positions $E_{p1}$ and $E_{p2}$ as shown in FIGS. 6A and 6E along respective ends 47 and 46 of mounting plate 14 without overhanging mounting plate 14. The length of mounting plate 14 accommodates wheels having larger diameters than conventional angularly mounted skate wheels. The length of the mounting plate, however, is small enough to simulate ice skating because the wheel base is approximately the same size as the blade of an ice skate. In this way, the skater can easily make the transition between roller skating and ice skating.

In a preferred embodiment employing three mounting holes per hanger as shown in FIG. 6A, hanger mounting holes 22 and 26 are aligned along axis $X_1$. Hanger mounting hole 24 is disposed at an angle $A_1$ from hanger mounting hole 22 and an angle $A_2$ from hanger mounting hole 26 along longitudinal axis $X_4$. Longitudinal axis $X_4$ is positioned nearer to outer edge 21 of mounting plate 14 than longitudinal axis $X_1$. Hanger mounting holes 28 and 32 are aligned along longitudinal axis $X_2$. Hanger mounting hole 30 is disposed along longitudinal axis $X_5$ at an angle $A_3$ from hanger mounting hole 28 and angle $A_4$ from hanger mounting hole 32. Longitudinal axis $X_5$ is positioned nearer to inner edge 23 than longitudinal axis $X_2$. The triangular configuration of the hanger mounting holes provides improved stability for the mounted hangers. However, other arrangements and different numbers of anchor holes can also be employed for a given hanger 18. Also, different series of hanger mounting holes 22, 24 and 26 and holes 28, 30 and 32 can be used to accommodate a selected number of hangers 18 that can be positioned on plate 14 of length $L_1$.

A pair of plate mounting holes 36 are positioned along lateral axis $X_6$ of mounting plate 14 and a pair of plate mounting holes 38 are positioned along lateral axis $X_7$ for mounting plate 14 to sole 15 of boot 12. Preferably, when mounting plate 14 is attached to the sole 15 of boot 12, lateral axis $X_6$ is positioned at position 37 generally at the ball of the foot of skater and lateral axis $X_7$ is positioned generally at position 39 generally at the central portion of the heel 40 of the skater. Mounting plate 14 can be selectively and removably mounted on either a right or left skate. If desired, the skater can remove a mounting plate 14, and remount it to the sole 15 of the other boot. Switching the mounting plates of the right and left boot reverses the angular orientation of the wheel at the front of the boot from being angulated toward the outer side of the boot to the inner side of the boot. This allows a skater to are tighter radius turns. Furthermore, the skater can rotate the removed mounting plate 14 before remounting it as desired.

The positioning of plate mounting holes 36 and 38 along lateral axis $X_6$ and lateral axis $X_7$ transfers foot movement from the ball and heel of the foot to mounting plate 14 in order to complement and control the skating motion, thereby reducing or minimizing skater fatigue and skeletal stress. The transfer of power primarily along lateral axes $X_6$ and $X_7$ allows the remainder of mounting plate 14 to absorb and dissipate vibration.

Referring again to FIG. 6A, the mounting plate 14 may be mounted to the sole of the boot using nuts and bolts. In particular, a bolt may be positioned through the sole and the mounting plate. Nuts may be attached to the bolts adjacent the mounting plate to secure the plate to the boot. Illustratively, the nuts may be standard hexagonal nuts or KEPS® nuts having a built-in washer. Additionally, fastening locking mechanisms or applications may be used such as nylon inserts, thread locking compounds or locking features on the nut itself to prevent the nut from unwinding on the bolt.

Figure 6B:
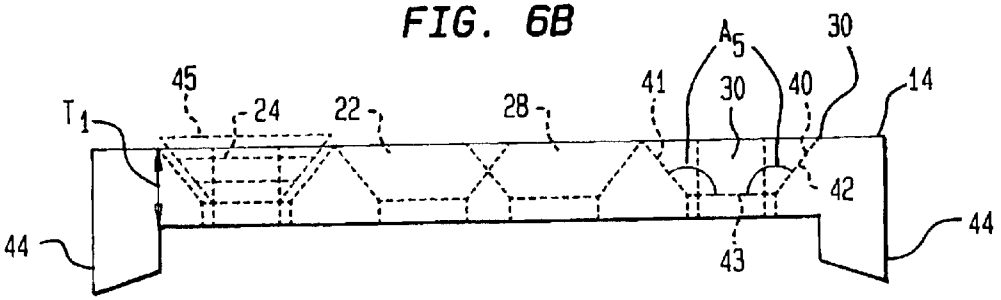
FIG. 6B is a front end view of the mounting plate, shown in FIG. 6A, including a phantom portion of a hanger fastener.

FIG. 6B illustrates a front end view of mounting plate 14. The downwardly extending side portions 44 provide increased structural support and rigidity to the mounting plate 14. Hanger mounting holes 22, 24, 28, 30 and mounting holes 26 and 32 (not shown) each have sides 41 and 42 angled at angle $A_5$ to aperture 43 for providing a tapered hole. The tapered hole helps to relieve stress from forces traveling from attached hanger 18 into mounting plate 14. Hanger mounting fasteners 45 can be selectively and removably inserted into predetermined series of hanger mounting holes 22, 24, 26 and holes 28, 30 and 32 from the boot side for adding or removing hangers 18 (not shown) at predetermined positions along mounting plate 14. In alternative embodiments, the fasteners can be positioned so that they screw into the plate from the hanger side.

Mounting plate 14 has a thickness of $T_1$ (FIG. 6B) which helps determine the distance the skater's foot is from the skating surface. Thickness $T_1$ is as thin as structurally permitted to optimally lower the skater's foot to the skating surface 95. Preferably, thickness $T_1$ of mounting plate 14 is in the range of about ⅛ of an inch to about ½ of an inch.

Figure 6D:
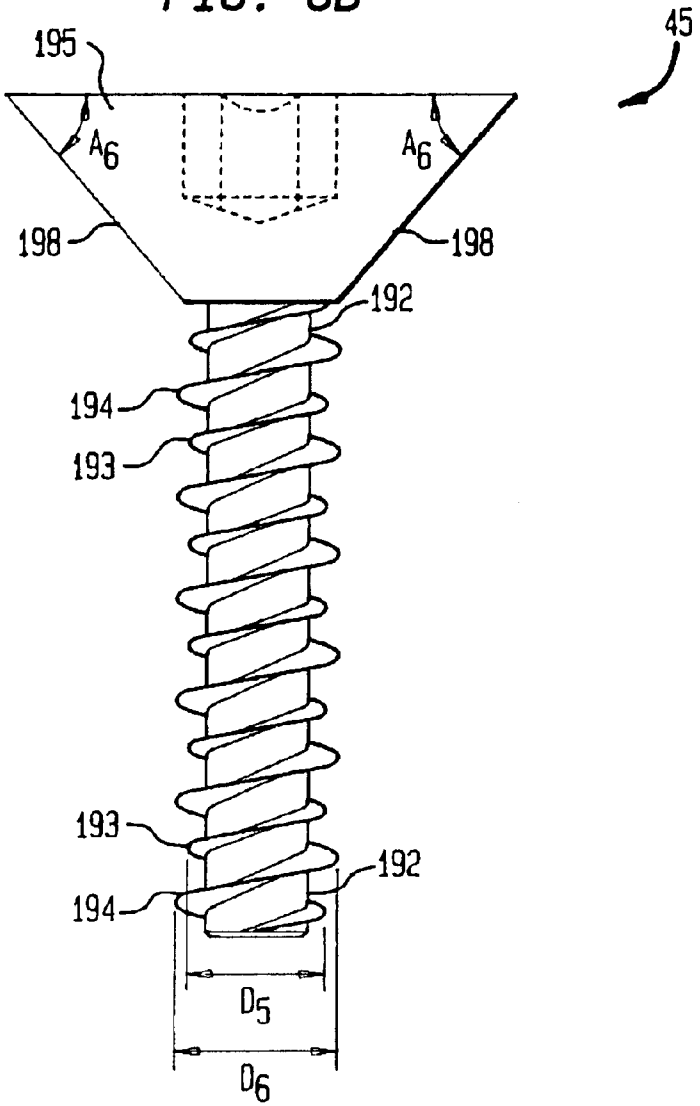
FIG. 6D is a side view of the hanger fastener, shown in FIG. 6C.
Figure 6C:
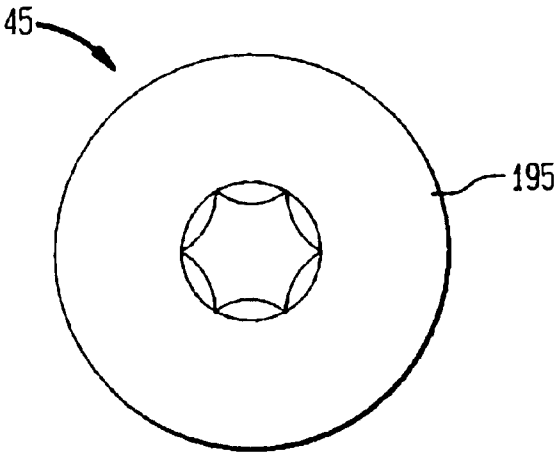
FIG. 6C is a top view of a hanger fastener for mounting the hanger to the mounting plate.
Figure 6E:
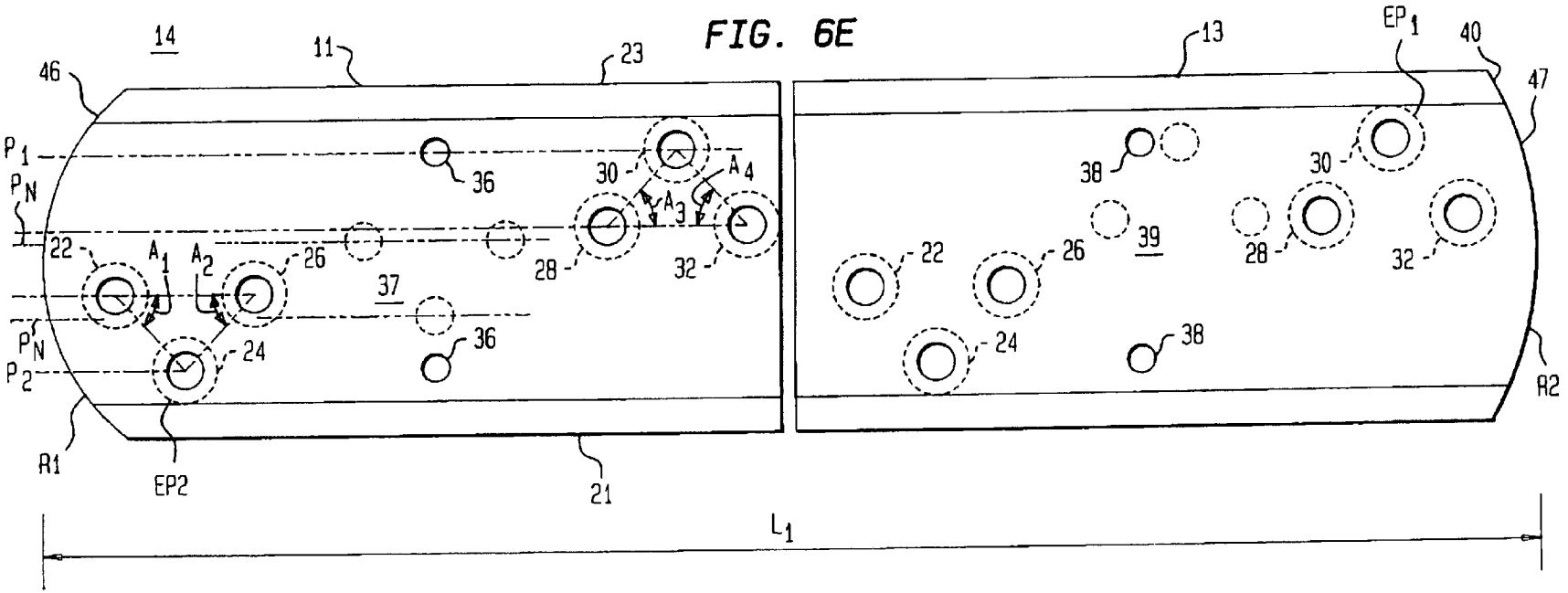
FIG. 6E is a bottom plan view of an alternative embodiment of the mounting plate shown in FIG. 6A.

FIGS. 6C and 6D illustrate hanger mounting fastener 45 which can be received, illustratively, in hanger mounting holes 22, 24, 26 of plate 14 shown in FIG. 6A. Hanger fastener 45 has a shank 192, threads 193 with diameter $D_5$ and threads 194 having diameter $D_6$ that is larger than diameter $D_5$. For example, diameter $D_5$ can be about 0.200 inches and diameter $D_6$ can be about 0.250 inches. When hanger fastener 45 is inserted in hanger mounting holes 22, 24, 26, threads 194 having larger diameter $D_6$ bend the material around hanger mounting holes 22, 24, 26 instead of cutting the material. Threads 193 having diameter $D_5$, which is smaller than diameter $D_6$, allows the bent material to relax and fill in to the diameter of smaller threads 193 before being bent by another large diameter thread. This increases the force of the material gripping the screw. The alternating of diameter sizes for threads 193, 194 increases the pullout strength of fastener 45 during vibrations and impacts of hanger 18 and mounting plate 14.

Head 195 of fastener 45 has sides 198 at an angle of $A_6$ from the top surface of head 195 for use in countersunk tapered holes 22, 24, 26. The tapered shape of head 195 displaces vibrations along fastener 45. Preferably, fastener 45 is formed of steel or other suitable material for preventing stress cracking of fastener 45.

Alternatively, other forms of fasteners known in 30 the art can be used in place of fastener 45. For example, interlocking brackets can be extended from mounting plate 14 to allow for selective and removable cooperating engagement with corresponding interlocking brackets on a hanger 18. Accordingly, the skater can expeditiously adjust not only the number but also the location of wheels along skate 10 in order to customize the skate for improved performance.

Alternatively, wheels 16, 17 can be mounted at any location along additional planes $P_n$ on mounting plate 14, as shown in FIG. 6E with additional hanger mounting holes positioned at various locations along planes $P_1$, $P_2$ and $P_n$ for adjusting the overlap between hangers 18 and for accommodating various wheel sizes as described above. In other alternative embodiments, hanger mounting holes can be positioned at any location on mounting plate 14 as long as the mounted wheels can be disposed in a generally angular relationship to each other that will not inhibit the skate from rolling forward, backward or turning.

In an alternative embodiment, mounting plate 14 can be integrally formed with boot 12 in a one-piece construction. In this embodiment mounting plate 14 has a width which is substantially the same as the width of the sole 15 of the boot 12. Similar to the previously described embodiment, the mounting plate in this embodiment will not contact the skating surface during angulation of the skate. If desired, some of the hangers can also be integrally formed with the mounting plate 14.

Figure 7:
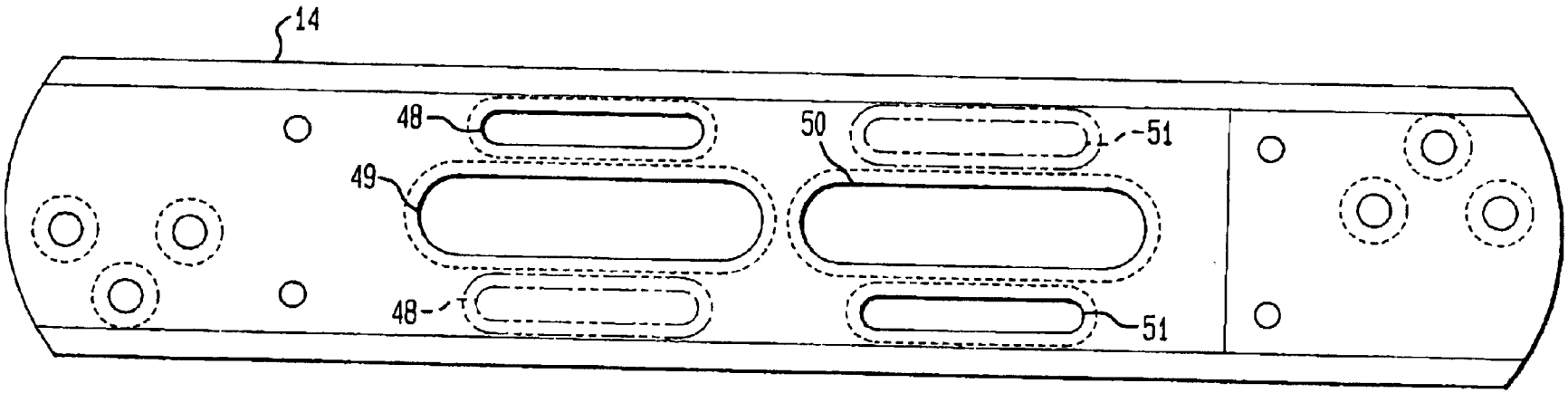
FIG. 7 is a bottom plan view of another alternative embodiment of the mounting plate according to the present invention.

FIG. 7 illustrates an alternative embodiment of mounting plate 14 having a hanger mounting slot 48 replacing hanger mounting hole 30 and hanger mounting slot 49 replacing hanger mounting holes 28 and 32. In this embodiment, mounting plate 14 also has hanger mounting slot 50 replacing hanger mounting holes 22 and 26 and hanger mounting slot 51 replacing hanger mounting hole 24. Hanger mounting slots 48, 49, 50 and 51 allow attached hangers 18 to be expeditiously adjusted to various desired positions and orientations on mounting plate 14 by sliding the hangers in the hanger mounting slots or reversing the hangers and accordingly adjusting the hanger mounting screws. It will be appreciated that the size and locations of slots 48, 49, 50 and 51 can be adjusted to accommodate advantageous selective placement of attached hangers on mounting plate 14.

In alternative embodiments, slots 49, 50 and their adjacent slots 48, 51, respectively, can be replaced with corresponding holes that will allow a hanger to be selectively and removably coupled to the mounting plate 14 in either of two alternative orientations.

Figure 8B:
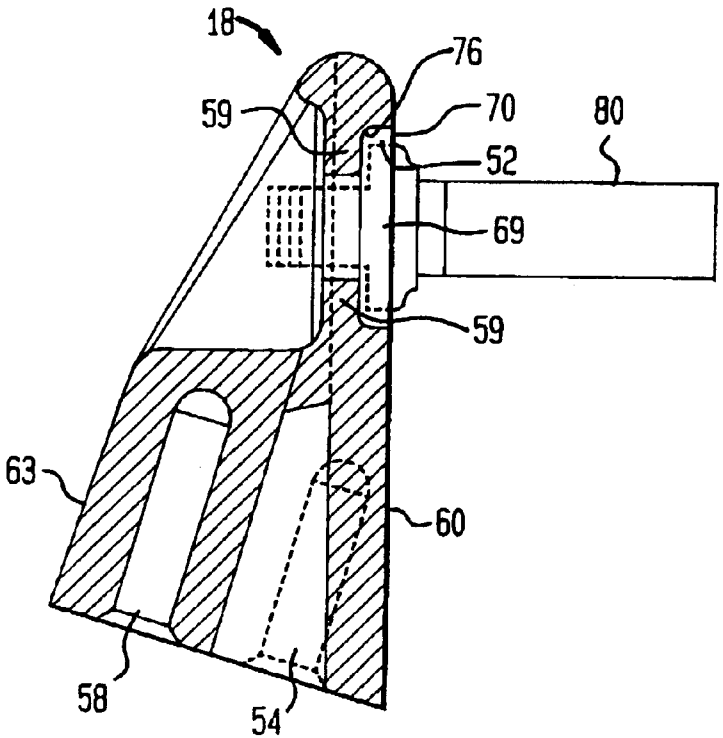
FIG. 8B is a side cross sectional view of the hanger shown in FIG. 8A with an axle.
Figure 8A:
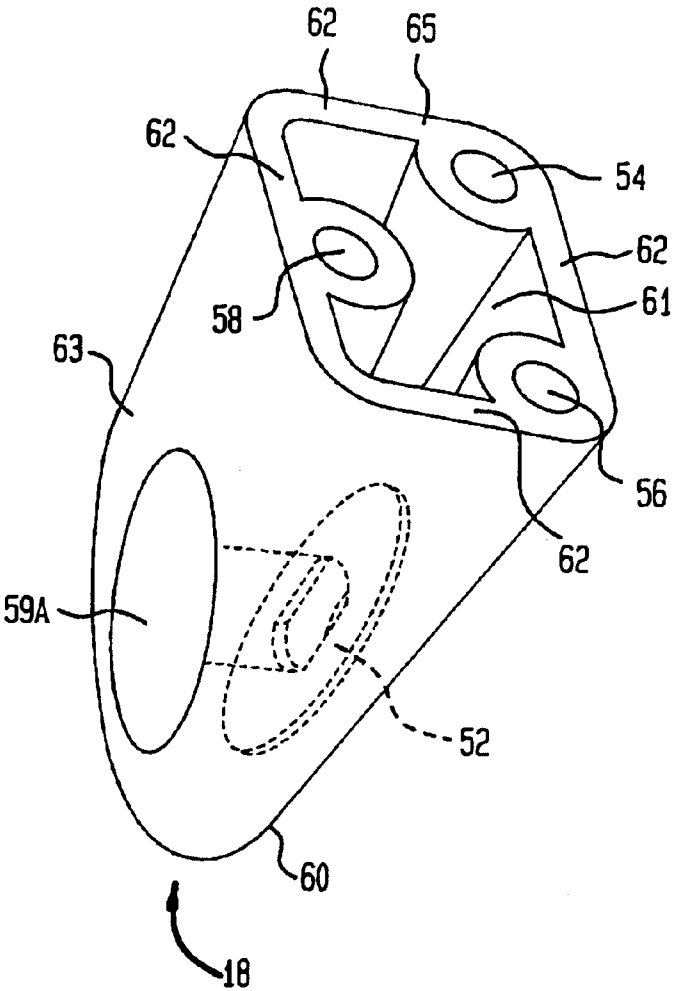
FIG. 8A is a perspective view of a hanger used for mounting the wheels according to the present invention.

Preferably, hanger 18 is a molded three dimensional conical shape, as shown in FIGS. 8A–8C. Hanger 18 has an open core 61 with solid perimeter sides 62. Hanger 18 can be formed of nylon, plastic, aluminum, steel, titanium, magnesium, carbon fiber and the like. In one preferred embodiment, hanger 18 is formed of a glass reinforced nylon, for example, Zytel 80G33L manufactured by Dupont. Hanger 18 is formed of inner side surface 60 angularly protruding from an outer side surface 63. Bottom surface 65 is formed integrally with the inner side surface 60 and outer side surface 63.

Hanger mounting holes 54, 56 and 58 can be matched, respectively, for example, to hanger plate mounting holes 22, 26 and 24 (shown in FIG. 6A) or hanger mounting slots 48 and 49 (shown in FIG. 7). Hanger mounting holes 54, 56 and 58 have a depth and diameter for optimally receiving a thread forming screw as shown in FIGS. 6C and 6D into the material of hanger 18. Alternatively, hanger 18 can be repositioned to mate with, for example, hanger plate mounting holes 28, 30 and 32 respectively to hanger mounting holes 54, 56 and 58 or hanger plate mounting slots 50 and 51.

Hanger 18 has molded boss aperture 52 formed in inner side surface 60. Hanger 18 has molded cavity 59*a* formed in outer side surface 63. An axle boss 69 as shown in FIG. 8B is formed to mate with boss aperture 52. Boss 69 is positioned on the axle as shown in FIG. 8B and which will be described with respect to FIGS. 9 and 11. Preferably, boss aperture 52 has a circular shape. Boss aperture 52 is formed of rounded edges 76 for forming the circular shape, as shown in FIG. 8B. Hanger 18 is formed with captive material 59 positioned between the boss aperture 52 and the cavity 59*a*. The captive material is formed of a particular thickness dependent upon the structural integrity of material used for the hanger 18. Such thickness creates a structural environment that is suitable for supporting the axle. This is advantageous because an improper design can result in the axle ripping out of boss aperture 52 when vibration or impact-induced torque is applied by the skater to the axle.

Figure 9:
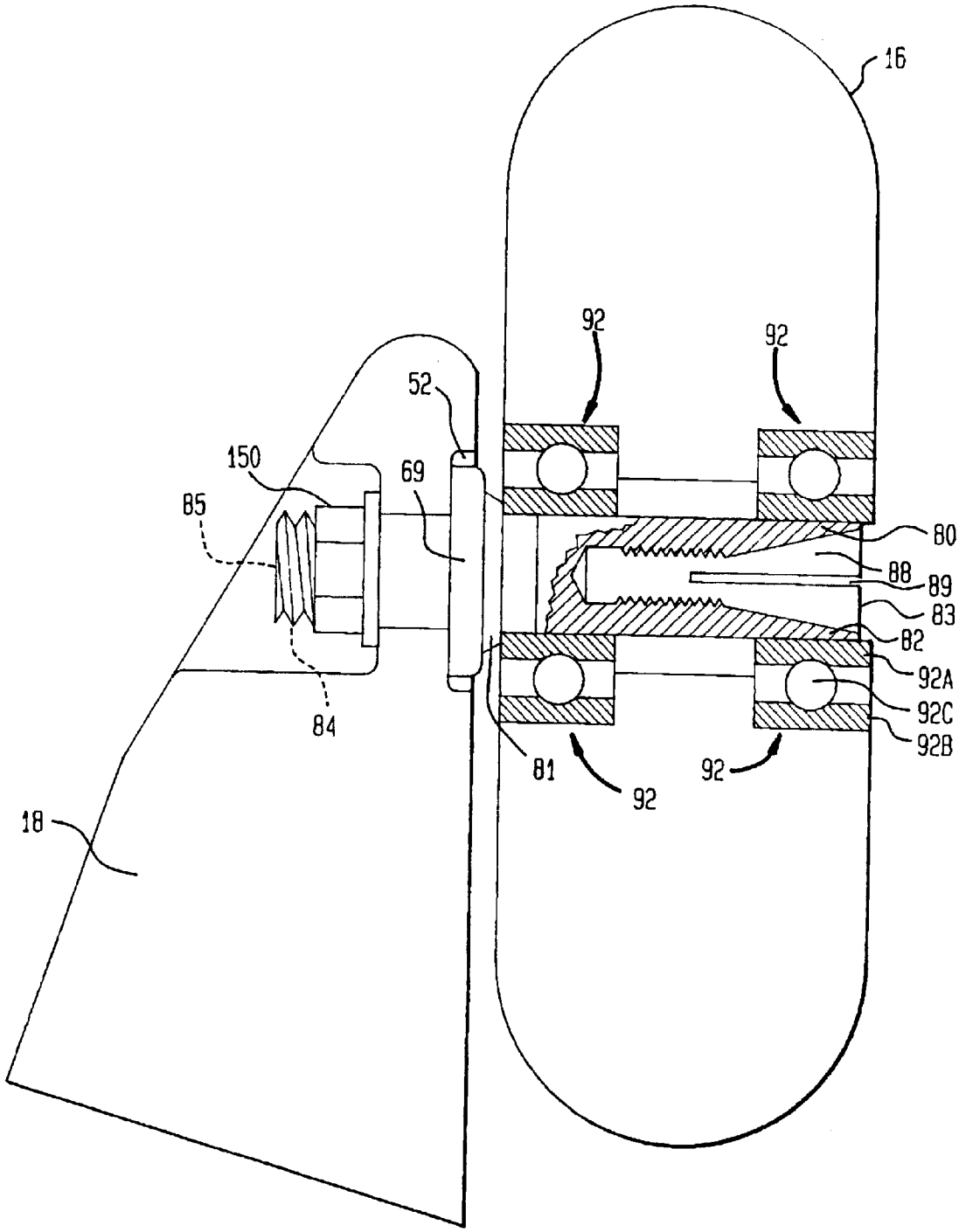
FIG. 9 is a side cross sectional view of a hanger in combination with a wheel and axle.

FIG. 9 illustrates axle 80. In one preferred embodiment, axle 80 is formed of steel in a cold heading process in which a slightly larger diameter of bar stock is compressed under high pressure and heat to fill a die in the shape of the axle. The cold heading process has the advantage of increasing structural integrity of the axle material. Preferably, axle 80 is a cantilever axle which includes boss 69, positioned within boss aperture 52. Boss 69 of axle 80 has a circular shape for mating with boss aperture 52 of hanger 18. The circular shape of boss 69 transfers forces from axle 80 to the perimeter of hanger 18, thereby displacing shock over the surface area of hanger 18 for reducing or minimizing concentrated stress on axle 80 and hanger 18 to reduce structural failures.

Axle bearing surface 82 is disposed at end 83 of axle 80 and threaded portion 84 is disposed at end 85 of axle 80. Fastener 150 can be attached to threaded portion 84 for holding axle 80 in place after insertion into hanger 18. Alternatively, axle 80 can be attached to hanger 18 by other methods such as insert molding, sonic insertion, welding, epoxy, insert screwing and the like. Wheel 16 is mounted on axle 80 on bearings 92 which are press fit into wheel 16 and comprise an inner race 92*a*, an outer race 92*b* and a bearing body 92*c*. Axle bearing surface 82 is inserted through inner race 92*a* of bearings 92. Inner race 92*a* is positioned adjacent a protruding flange 81 of hanger boss 69. Flange 81 protrudes so that hanger 18 does not contact wheel 16 which could interfere with the smooth rolling action of the wheels. An axle tip screw 100 as shown in FIGS. 10A and 10B is inserted into a screw aperture 88 of axle 80 for securing wheels 16, 17 to axle 80. Screw aperture 88 has expansion slots 89 on two sides thereof. Preferably, slots 89 are about ⅓ the length of axle bearing surface 82.

Shock or vibration transferred from wheels 16, 17 to hanger 18 travels down axle 80 through boss 69 into the sides of hanger 18 and into mounting plate 14. The components of hanger 18 are formed of a predetermined thickness for providing reduced stress which occurs with having excess material and excessive breakage which occurs with having too thin of a material.

Figure 11:
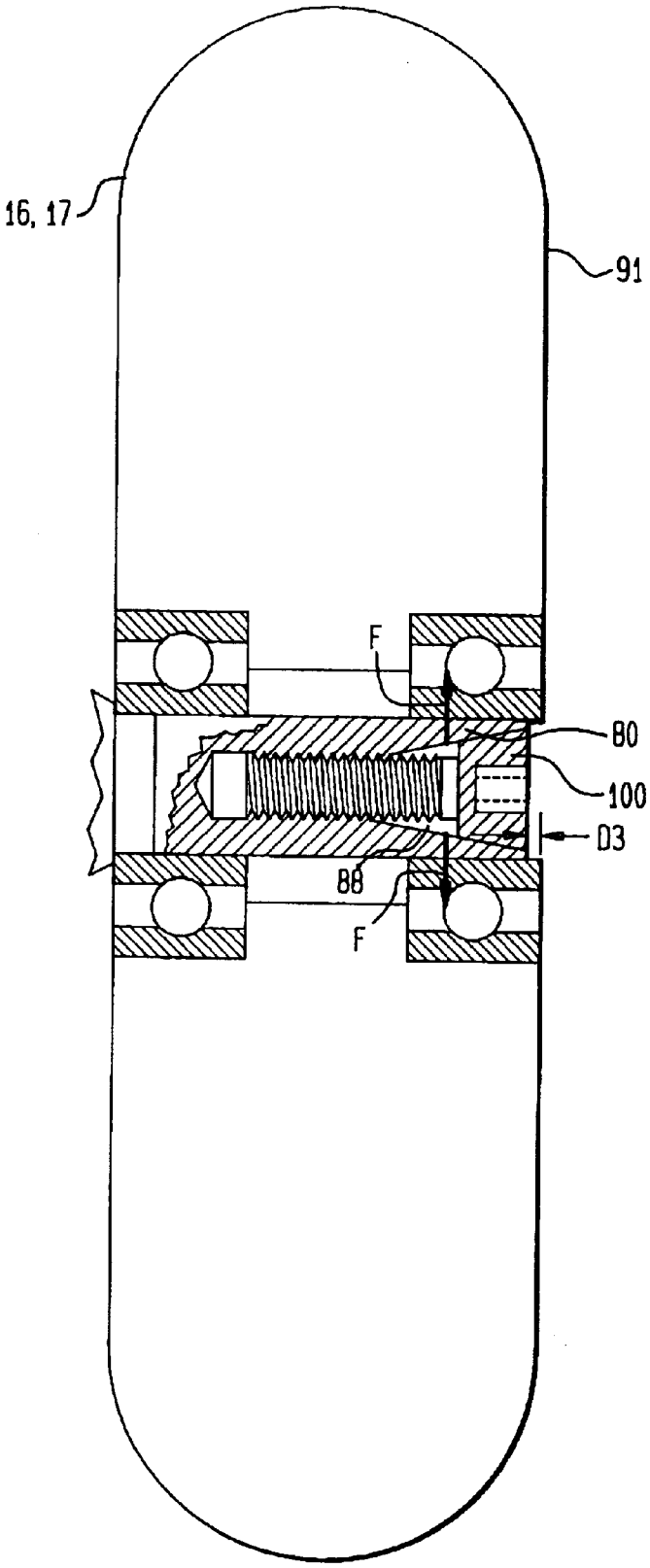
FIG. 11 is a side cross sectional view of a wheel in combination with an axle that has been secured with an axle tip screw.

Axle tip screw 100, shown in FIGS. 10A, 10B and 11, is received in screw aperture 88 shown in FIG. 9 for tightening wheels 16, 17 to hanger 18. Axle tip screw 100 has tapered sides 101 and a flat head 102. Threaded portion 104 of axle tip screw 100 mates with an threaded inner portion of screw aperture 88. Preferably, flat head 102 has a cavity for matching a wrench of similar shape. In particular, embodiments may include flat head 102 having a hexagonal cavity 106 or a TORX® cavity (not shown) for matching a wrench of similar shape for easily tightening and loosening wheels 16, 17 to and from hanger 18. Preferably, wheels 16, 17 release upon a ¼ turn of axle tip screw 100 to reduce the time for rotating or changing wheels.

FIGS. 10C–10D illustrate a KEPS® nut fastener 150 comprising a nut with a built-in washer which is received on threaded portion 84 of cantilever axle 80. Once seated, the fastener 150 of axle 80 does not protrude from hanger 18. Fastener 150 can have a circular shape to distribute forces $F_2$ away from axle 80 for reducing the stress on the axle and hanger. Fastener 150 includes threads 153 which mate with threaded portion 84 of axle 80 and a fastener locking mechanism or application can be supplied to threads 153 before insertion on the threaded portion 84. The fastener locking mechanism or application prevents fastener 150 from backing off due to excess vibration of axle 80. Alternatively, fastener 150 is a hexagonal nut having a thickness which does not protrude from hanger 18 beyond outer side surface 63, thereby preventing interference of fastener 150 with the skating surface during angulation of the skate.

The hexagonal nut can be coupled to a flat washer and a conical washer to increase the structural integrity of the union of the axle and hanger. FIGS. 10E and 10F illustrate conical washer 170 which can be used with fastener 150. Washer 170 can be received on threaded portion 84 between hanger 18 and fastener 150. Washer 170 has a spring portion 173 surrounding an aperture 172. This spring portion enables an increased load in the axle-hanger joint which alleviates loss of tension in the joint. FIGS. 10G and 10H illustrate a flat washer embodiment that may be used in conjunction with the conical washer or alone. Washer 180 is a flat washer having aperture 182. Washer 180 has the advantage of having low manufacturing costs.

As is illustrated in FIG. 11, insertion of the tip screw 100 causes lateral forces, F, to expand the screw aperture 88 via expansion slots 89. This holds the axle securely to the bearing. Axle 80 is formed so that it does not contact the skating surface upon angulation of the skate. Axle tip screw 100 is positioned within wheels 16, 17 so that it is flush or recessed a distance $D_3$ within the side surfaces of the wheels.

Figure 12:
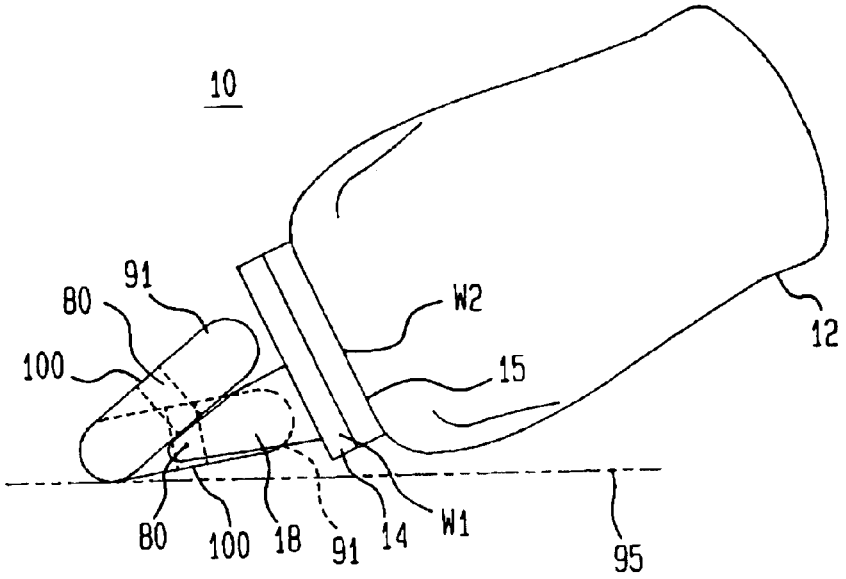
FIG. 12 is a rear view of the skate after angulation of the skate rightwardly towards the skating surface.
Figure 13:
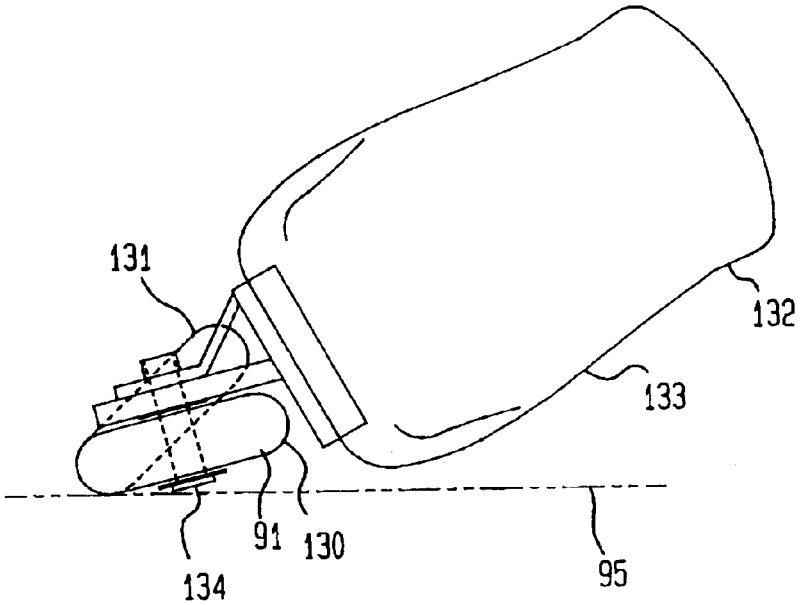
FIG. 13 (PRIOR ART)
FIG. 13 is a rear view of a prior art skate (U.S. Pat. No. 5,303,940) after angulation of the skate rightwardly towards the skating surface.

Side surface 91 of wheels 16, 17 can contact the skating surface if the wheels are angulated before the axle tip screw 100 or axle 80 (FIG. 12), thereby preventing wear of the axle and unrecoverable sliding by the skater. FIG. 13 shows a prior art axle 134 described in U.S. Pat. No. 5,303,940. Angulation of side 133 of boot 132 to skating surface 95 allows axle 134 to contact skating surface 95 before boot 132. The contact of axle 134 with skating surface 95 creates undesirable wear on axle 134 and can result in uncontrollable skidding of the skate.

Figure 14:
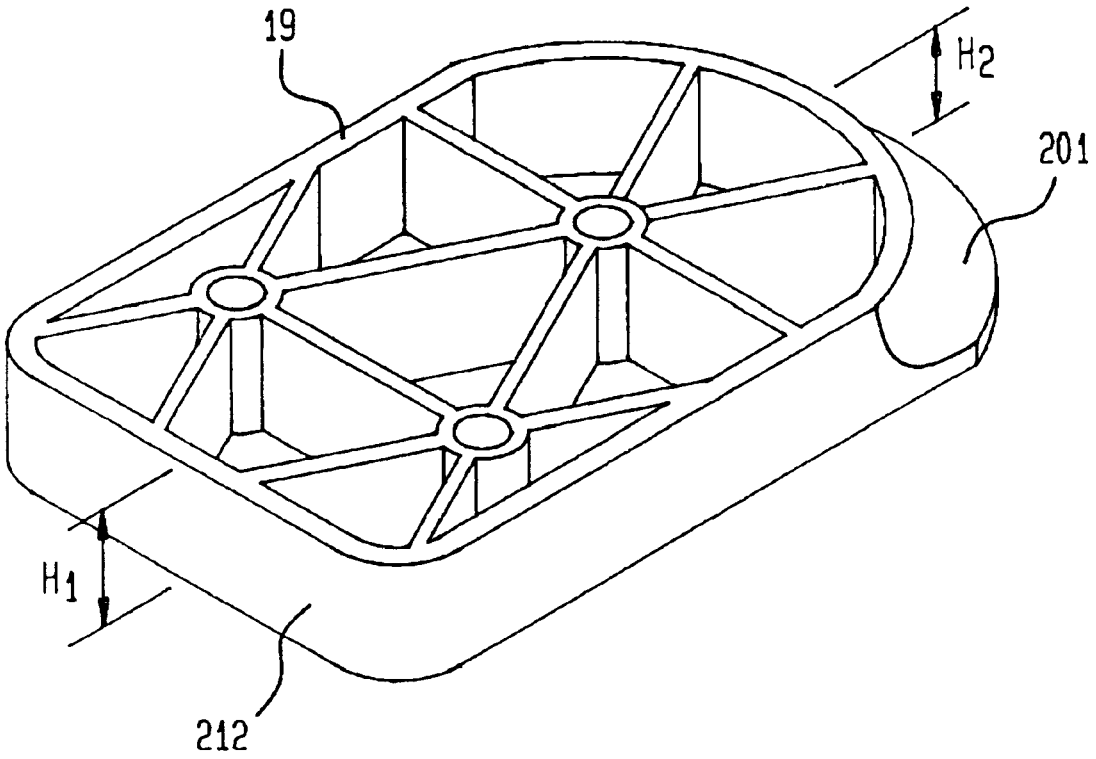
FIG. 14 is a side perspective view of a heel spacer used in the skate.

FIG. 14 depicts heel spacer 19 having a contoured shape. Preferably, heel spacer 19 is tapered with height $H_1$ of side 212 being less than $H_2$ of side 201. Heel spacer 19 enables boot 12 to be mounted at a predetermined angle to the mounting plate 14 and transfers a skater's weight from the boot to the plate.

In general, the present invention has the advantage that wheels can be selectively and removably mounted on a mounting place in a generally angular construction using hangers and a mounting plate which does not interfere with the skating surface during angulation of the skate. In a preferred embodiment, the hangers can be mounted longitudinally in at least two sets corresponding to the foot's power points, the ball and heel of the foot, for providing an increase in performance. Moreover, the hangers can be mounted laterally at two centers over which the skater's weight is positioned for providing ease in angulating the skate. An axle for mounting a respective wheel is aligned with the wheel and recessed from the outer surface of the wheel so that the axle does not contact the skating surface during angulation of the skate causing an unrecoverable slide.

While the invention has been described and illustrated herein with reference to the preferred embodiments thereof, it will be appreciated by those of ordinary skill in the art that various modifications, adaptations and variations can be made to the structure and form of the invention without departing from the spirit and scope of the present invention which is not intended to be limited to the exemplary embodiments described and illustrated herein. Instead, the present invention is set forth in the claims below.

We claim:

1. Customizable skate comprising:

boot having a sole and side surfaces, said sole having a ball region, a heel region and a plane;

plate member coupled to the sole;

first hanger set comprising two separate hangers wherein each of said two hangers is individually selectively and removably coupled to the plate member and the sole about the ball region, and a second hanger set comprising two separate hangers wherein each of said two hangers is individually selectively and removably coupled to the plate member and the sole about the heel region, wherein said first hanger set is spaced from said second hanger set at a distance unequal to at least one of either the distance between said hangers of the first set or the distance between said hangers of the second set; and wheels rotatably coupled to said corresponding hangers in an alternating angular configuration relative to and along the plane of the sole, and positioned so that all adjacent wheels are not evenly spaced from each other each wheel as well as its corresponding hanger being capable of being selectively removable apart from any other wheel and its corresponding hanger.

* * * * *